137-13 SR
8/31/76 XR 3,977,469

United States Patent [19]
Broussard et al.

[11] 3,977,469
[45] Aug. 31, 1976

[54] CONSERVATION OF WATER FOR CORE FLOW

[75] Inventors: Douglas E. Broussard; Paul R. Scott; Vitold R. Kruka, all of Houston, Tex.

[73] Assignee: Shell Oil Company, Houston, Tex.

[22] Filed: Feb. 3, 1975

[21] Appl. No.: 546,382

[52] U.S. Cl. ..... 166/266; 166/267; 166/303; 137/13

[51] Int. Cl.[2] ..... E21B 43/22; E21B 43/24; F17D 1/16

[58] Field of Search ..... 137/13, 604; 166/266, 166/267, 308, 314

[56] References Cited

UNITED STATES PATENTS

| | | | |
|---|---|---|---|
| 3,006,354 | 10/1961 | Sommer et al. | 137/13 |
| 3,338,173 | 8/1967 | Gunzel, Jr. et al. | 137/604 X |
| 3,354,952 | 11/1967 | Engle | 166/266 |
| 3,378,074 | 4/1968 | Kiel | 137/13 X |
| 3,425,429 | 2/1969 | Kane | 137/13 |
| 3,434,485 | 3/1969 | Lummus | 137/13 |
| 3,491,835 | 1/1970 | Gagle | 137/13 X |
| 3,502,103 | 3/1970 | Verschuur | 137/13 X |
| 3,519,006 | 7/1970 | Simon et al. | 137/13 |
| 3,520,313 | 7/1970 | Seymour | 137/13 |
| 3,730,276 | 5/1973 | Land | 137/13 X |

*Primary Examiner*—Stephen J. Novosad

[57] ABSTRACT

Water employed for the pipeline transmission of an oil core inside a water annulus is conserved by continuously recycling the water either for further use as a core flow fluid or for use in oil production.

35 Claims, 1 Drawing Figure

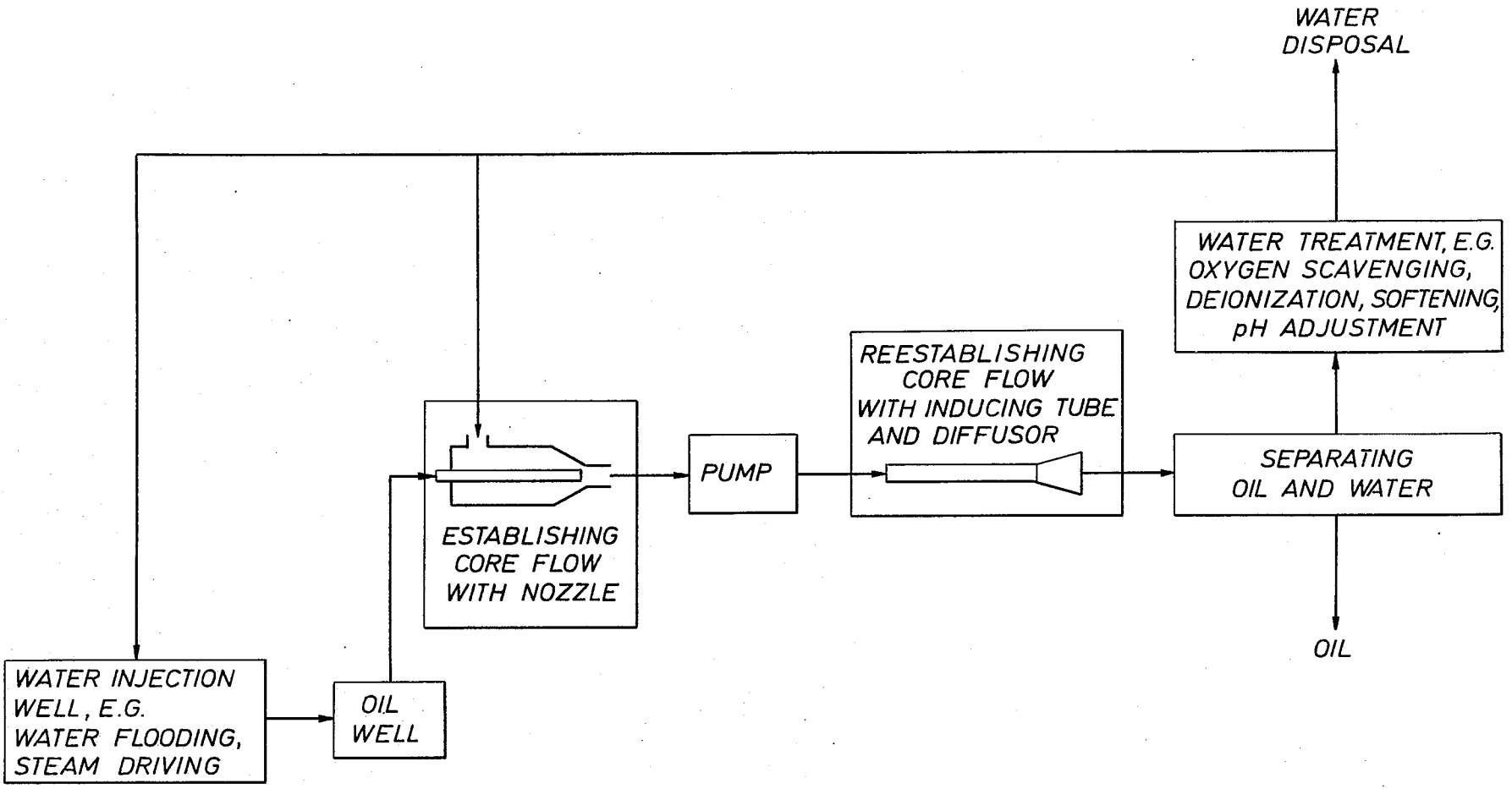
WATER DISPOSAL
WATER TREATMENT, E.G. OXYGEN SCAVENGING, DEIONIZATION, SOFTENING, pH ADJUSTMENT
SEPARATING OIL AND WATER
OIL
REESTABLISHING CORE FLOW WITH INDUCING TUBE AND DIFFUSOR
PUMP
ESTABLISHING CORE FLOW WITH NOZZLE
OIL WELL
WATER INJECTION WELL, E.G. WATER FLOODING, STEAM DRIVING

CONSERVATION OF WATER FOR CORE FLOW

BACKGROUND OF THE INVENTION

1. Field of the Invention

Core flow is the pumping through a pipeline of a viscous waxy liquid such as oil, oil suspension, or oil emulsion in a core surrounded by a lighter viscosity liquid, such as water, at essentially the pressure drop of the lighter viscosity liquid. Normally, core flow is established by injecting water by separate means around a viscous or waxy oil being pumped in a pipeline. However, core flow can also be established by creating a certain shear rate for a certain length of time in a pipe flow to break an emulsion and create a water rich zone near the pipe wall. Any light viscosity liquid vehicle such as water, petroleum and its distillates may be employed as the annular liquid. Any high viscosity liquid such as petroleum and its by-products and mixtures thereof including solid components such as wax and foreign solids such as coal or concentrates, etc. may be employed for the core.

2. Description of the Prior Art

A substantial quantity of water is required for core flow. Inasmuch as crude oil as it is normally produced from oil wells contains some water, it may be a source of some or all of the water needed for core flow. This water is not difficult to separate from crude oil where the oil/water mixture contains only free water which will separate easily from the oil by merely providing a vessel in which water/oil phase separation occurs through the difference in gravities of the water and the oil. Where the water is dispersed through the oil in small particles, separation is more difficult inasmuch as minute particles of water are dispersed in the oil in a very stable condition due to the extensive area of interface between the water and the oil.

Even provided the water required can be obtained in part or in whole from the produced crude oil, there still remains a problem of disposal of the water once it has served its purpose in facilitating transport of the crude oil to a terminal station. Such water when gravity separated from the crude oil still contains at least some quantity of oil so that discharge into streams is unacceptable. Disposal into wells may also be undesirable, and further cleanup of the water may add substantially to the expense of the entire operation.

The present invention provides a solution to the above noted problems and presents alternative techniques for taking full advantage of water required for core flow, as will be apparent from the following description thereof.

SUMMARY OF THE INVENTION

A primary purpose of this invention resides in providing a process for transporting crude oil in a pipeline by core flow and recycling water employed for the core flow. The recycled water may also be utilized for increasing oil production either by injection into the oil field or the oil wells with suitable additives.

Another purpose of this invention resides in the utilization of water taken from produced water/oil emulsions to establish core flow and then recycling such water for further use as a core flow fluid or to increase oil production.

More specifically, the present invention provides a process for producing oil from an oil well and transporting the oil to a terminal station by utilizing water to recover oil from an oil formation through an oil well; producing the oil from the oil well; establishing core flow of the oil inside an annulus of water inside a conduit; transporting the resulting oil core in water annulus to a terminal station; separating the oil and water; and returning at least part of the water to be utilized for oil recovery and/or for establishing core flow.

The present invention also involves a process for producing oil from an oil well and transporting the oil to a terminal station by utilizing water to recover oil from an oil formation through an oil well; producing the oil as a water-in-oil emulsion from the oil well; subjecting the emulsion to a certain shear rate and conduit flow for a sufficiently long time to break the emulsion and create a water rich zone near the conduit wall; transporting the resulting oil core in water annulus to a terminal station; separating the oil and water; and alternatively returning a part of the water to be utilized for oil recovery.

Additionally, there is provided a process for producing oil from an oil well and transporting the oil to a terminal station by utilizing water to recover oil from an oil formation through an oil well; producing the oil as a water-in-oil emulsion from the oil well; adding water to the emulsion; subjecting the added water and emulsion to a certain shear rate in conduit flow for a sufficiently long time to break the emulsion and create a water annulus to a terminal station; separating the oil and water; and returning at least part of the water to be utilized for oil recovery and/or for establishing core flow.

This invention also provides a process for transporting crude oil from an oil well to a terminal station by producing crude oil from an oil well; establishing core flow of the oil in an annulus of water inside a conduit; transporting the resulting oil core in water annulus to a terminal station; separating the oil and water; and returning at least part of the water to the oil well to be utilized for establishing core flow.

The present invention further includes a process for transporting crude oil from an oil well to a terminal station by producing a water-in-oil emulsion from an oil well; adding water to the emulsion; subjecting the added water and emulsion to a certain shear rate in conduit flow for a sufficiently long time to break the emulsion and create a water rich zone near the conduit wall; transporting the resulting oil core in water annulus to a terminal station; separating the oil and water; and returning at least part of the water to the oil well to be added to the produced emulsion.

Within the framework of the above described processes, the present invention not only solves the above mentioned problems of the prior art, but also achieves further significant advantages, as will become apparent hereinafter.

DESCRIPTION OF THE DRAWING

The process of the invention is depicted schematically in the drawing.

DESCRIPTION OF PREFERRED EMBODIMENTS

The present invention involves a system incorporating several components which may be used individually or in combination and are thought to be especially beneficial in the conservation of water for use in core flow, water or steam injection, and the like. The system of this invention in general involves an oil field and oil wells, water injection modulating valves, core flow nozzle, a core flow inducing tube or tubes, a crude oil gathering network, a water disposal system, a water distribution network, a water treatment plant, and a dehydration plant. The dehydration plant removes water from oil such that the oil is of pipeline quality. The water treatment plant purifies the water by removing residual oil and the like for disposal or for later use in water flooding, steam drive, or pipeline core flow. The water may be scavenged of oxygen, deionized, softened, its pH may be adjusted and additives may be injected so as to make and maintain steel surfaces hydrophilic by the use of sodium silicate additive and the like. The water disposal system involves injection wells or other disposal means for unwanted water. Desired water is distributed to required locations such as oil wells via a water distribution system. The crude oil gathering network connects separate oil wells to a central dehydration plant or other central collecting point. The core flow inducing tube creates core flow in flow lines for water/oil emulsions of viscous or waxy crudes. A core flow nozzle creates core flow in flow lines with relatively dry oil of less than 5% water by injecting water around a central core. The water injection modulating valve serves to control the water injection through the core flow nozzle in systems which produce water/oil emulsions of variable water content by injecting water as, at the desired flow rate, the pressure drop begins to exceed a predetermined and set value. The core flow thus produced in the flow lines substantially eliminates contact between the oil and pipe walls resulting in lower pressure drops and higher, stable flow rates. The contact can be further limited by adding sodium silicate to the water at the water treating facility. A portion of the suitably sodium silicate treated water may also be metered into the oil well tubing casing annulus and then into the tubing to commingle with the produced fluids to make the tubing hydrophilic and to prevent viscous or waxy oil from adhering to the tubing and wellhead equipment.

Viscous water in oil emulsions are frequently produced during thermal secondary recovery of viscous crude oils and are a ready source of water for purposes of core flow. The present process involves creating a substantially high shear rate for a long enough time to break the emulsion and separate it into viscous liquid (oil) and less viscous liquid (water) phases. The shear rate, however, must not approach or exceed the value beyond which emulsification of the viscous liquid and less viscous liquid will occur. The required shearing forces may be applied to the emulsion in a number of ways, such as by agitating the emulsion with mechanical agitating means such as impellers or other devices. However, it is preferred to apply shearing forces to the emulsion by means of pipe flow inasmuch as this creates core-flow by establishing a less viscous liquid rich zone near the pipe wall which thus drastically reduces the flow pressure drop in the pipeline. Irrespectful of the combination of means employed to apply the shearing force to the emulsion, enough shearing force must be imparted to the emulsion for a sufficiently long time to coalesce the less viscous liquid. The amount of work required for coalescing strongly depends on the viscosity of the emulsion and varies between about 0.05 and about 50,000 foot-pounds per pound of emulsion. The use of additional amounts of shearing work usually produces no added benefit for the extra cost and may be harmful in that it may lead to re-emulsification. Similarly, the use of less than about 0.05 foot-pounds of shearing work per pound of emulsion also does not usually produce any desired result in coalescing the less viscous liquid (water). Emulsion breaking is useful with viscous emulsions of various liquids ranging in viscosity from about 10 to about 1,000,000 cs, or more preferably from about 100 to about 500,000 cs. The invention is also useful with emulsions containing a minor to a large quantity of less viscous liquid. Specifically, the less viscous liquid content may range from about 5 to about 60%v, or more preferably from about 10 to about 55%v. Generally, if the viscous liquid contains less than about 5%v, it is feasible to separate out the water by use of the present invention to form a purified viscous liquid, but on the other hand, there may not be enough water to allow core-flow of the viscous liquid inside a less viscous liquid annulus. In this circumstance, some additional water may be injected into the flow so as to achieve core-flow. At the other extreme, if the viscous liquid contains more than 60%v less viscous liquid, there is too much less viscous liquid so that core-flow may not be economically effected. In this latter circumstance, some of the less viscous liquid may be separated and the remaining less viscous liquid retained for core-flow purposes.

It is preferable to break emulsions in laminar pipe flow, although turbulent flow may be utilized. Generally, such flow is established that the shear rate, based on zero-shear viscosity, is maintained between about 2 and about 5000 1/sec. Preferably, the shear rate is maintained at about 5 to about 500 1/sec. Under these conditions, the length of the tube, pipe, or other means for establishing flow is such that the residence time of the emulsion in the tube is sufficient to allow migration of the suspended less viscous liquid droplets. Generally, the minimum required residence times, depending upon the percentage of water, the viscosity of the viscous liquid, temperatures, pressure, and diameter of pipe, is from about 0.1 to about 200 seconds. A more preferred range is from about 2 to about 100 seconds. The longer residence times allow the use of lower shear rates.

After the emulsion is passed through the core-flow creating tube or pipe, the pipe may be increased in size by means of a conical diffusor, decreased in size by an inverted diffusor or continued in the same size pipe. The choice, of course, depends upon the desired pipeline flow rate. A fast rate tends to destroy core-flow inasmuch as the swirls and eddy currents in the viscous liquid and less viscous liquid layers tend to cause intermixing of the two whereby the viscous liquid and less viscous liquid are re-emulsified and core-flow is lost. On the other hand, a very slow rate also tends to destroy core-flow inasmuch as at such rates gravitational effects overcome the weak secondary flows suspending the viscous liquid within the less viscous liquid annulus and allow the viscous liquid to touch the pipe wall leading to the loss of core-flow. Thus, a flow rate must be chosen which tends to maintain core-flow throughout the length of the pipeline. Once it is decided to either decrease or increase the pipe size, the diffusor to be employed preferably has an angle of from 1° to 30° and more preferably to from about 1° to about 9° to avoid re-emulsification due to flow separation.

The emulsion breaking technique of this invention solves the problem of passage of a core-flow system through booster pumps in a pipeline without prior separation of the less viscous liquid from the viscous liquid or additional less viscous liquid injection after booster pump. The highly intense turbulent shear present in centrifugal pumps or the less intense shear present in positive displacement pumps tends to disperse, and sometimes emulsify, the annular less viscous liquid with the viscous liquid. U.S. pat. No. 2,821,205 teaches that the oil and water must be separated prior to passage through the booster pump in order to avoid such emulsification. The alternative solution to this is that new water or other less viscous liquid be added after the booster pump to continue core-flow of an emulsion. The present emulsion breaking technique eliminates this need for either water-oil separation or the use of additional water inasmuch as it allows the reformation of core-flow even though pumps have tended to emulsify or disperse the water in the oil.

Other crude oils which are not emulsions, e.g. highly viscous or waxy crude oils, may also be difficult to transport by pipeline unless treated in a manner to reduce flow resistance. Core flow is successfully employed with such crudes. In the prior art, a mixing section for forming core flow is employed having a fixed ratio of areas through which the oil and water pass into an oil/water mixing section. When the oil velocity is greater than the water velocity at the point of contact, the oil core has a tendency to spiral into the pipeline and disrupt core flow. When the oil velocity is lower than that of the water, the core tends to break up into segments likewise disrupting core flow. As a part of the present invention, a nozzle is provided for establishing stable core flow of a viscous or waxy oil surrounded by an annulus of water in a pipline. The nozzle has a variable area ratio mixing section whereby adjustments can be made to avoid situations where the oil velocity is greater than the water velocity at the point of contact, so that the oil core has a tendency to spiral into the pipeline, or where the oil velocity is lower than that of the water, so that the core tends to break up into segments, neither of these conditions being desirable. The nozzle utilized by this invention allows a change in the water-to-oil ration in order to first, change the flow rate of the mixture, second, better utilize the low viscosity fluid and/or third, increase or decrease the throughput. By use of this nozzle, the velocities of the two fluids can be matched when the water-to-oil ratios are between about 1:1 and 0.1:1.

Several desirable features are incorporated into the oil/water mixing nozzle: first, the design of the nozzle for the viscous or waxy fluid can be utilized for the development of a flat velocity profile; second, the velocity of the low viscosity annular fluid, normally water, can be changed to match the velocity of the viscous fluid by changing the cross-sectional area of the exit, whereby the operator can then match the velocities of the two fluids, thereby aiding in the immediate establishment of stable core flow; third, the cross-sectional area of the mixing section beyond the point of contact of the two fluids can be gradually reduced, thereby suppressing turbulence, increasing the mean velocity and generally aiding in the establishment of stable core flow; and fourth, the mixing section can be disassembled for cleaning, inspection and/or for exchange of parts, and the end of the viscous fluid nozzle can be inspected and kept clean to reduce turbulence at the interface between the fluids.

Water to be employed for either core flow or for injection into oil wells may be treated with an oleophobic film-forming agent which is an aqueous solution of a water-soluble salt selected from silicates, borates, carbonates, sulfates, phosphates and mixtures thereof. Providing contacting surfaces with a coating of these salts prevents the adherence of waxy crude components of waxy crude oil and fractions thereof. Such surfaces may be those associated with the production of oil from an oil well so that the process involves injecting into the well an aqueous solution of the oleophobic film-forming agent. Tubing and sucker rods in the well may be pretreated with the water-soluble salt to deposit the oleophobic film thereon. In addition, a barrier of an aqueous solution of the oleophobic film-forming salt may be maintained between the surfaces and the waxy crude components, as for example in the core-flow technique, above discussed, wherein the surfaces comprise the interior of a pipe and the agent is maintained as a surrounding film about the waxy crude components.

After core flow has been induced at the wellhead, the crude oil is gathered into a gathering network and sent to a terminal station where a dehydration plant removes substantially all water from the oil. A water treatment plant then purifies the water whereafter it is either sent to a water disposal system which may include injection wells or other disposal means or the water may then be recycled to be used for waterflood or steam drive. If the water is to be further utilized for pipeline core flow, it may be treated to scavenge it of oxygen, deionized, softened, have its pH adjusted, or combined with additives as hereinabove mentioned such as silicates, then sent to a water distribution system, and finally back to the oil wells for use there either for injection or core flow. As already mentioned, the oil which comes from the wells of water by means of a core flow nozzle and a water injection modulating valve or if the oil is in the form of emulsion, it may be transformed to core flow by conduit shearing. Depending upon the amount of water in the emulsion, water may or may not be added to the latter.

We claim as our invention:

1. A process for producing oil from an oil well and transporting the oil to a terminal station comprising:
- utilizing water to recover oil from an oil formation through an oil well;
- producing the oil from the oil well;
- establishing core flow of the oil in an annulus of water inside a conduit;
- passing the core flow through a pump in the conduit to form an emulsion and subjecting the emulsion to sufficiently high shear rate in conduit flow for a sufficiently long time to break the emulsion and create a water rich zone near the conduit wall and reform the core flow;
- transporting the oil and water to a terminal station;
- separating the oil and water; and
- returning at least part of the water to be utilized for oil recovery and/or establishing core flow.

2. The process of claim 1 wherein the water is injected into the oil formation to drive the oil to the oil well.

3. The process of claim 1 wherein the water is converted to steam which is injected into the oil formation to stimulate flow of the oil well.

4. The process of claim 1 wherein the water is combined with a water-soluble salt selected from the group consisting of silicates, borates, carbonates, sulfates, phosphates and mixtures thereof and injected into the oil well to coat surfaces therein with a coating of the salt and reduce the adherence of the crude oil to the surfaces, whereby production of oil from the oil well is improved.

5. The method of claim 4 wherein the oil contains a high percentage of waxy components.

6. The process of claim 1 wherein the water is combined with a water-soluble salt selected from the group consisting of silicates, borates, carbonates, sulfates, phosphates and mixtures thereof and utilized to establish core flow, whereby transportation of the oil is improved.

7. The process of claim 1 wherein the water is combined with water-soluble friction reducing polymers and utilized for establishing core flow.

8. The process of claim 1 wherein core flow inside a pipeline is established with a nozzle having a variable area ratio mixing section, and the ratio is changed where oil velocity is greater than water velocity at the point of contact so as to avoid causing the oil core to spiral into the pipeline or where the oil velocity is lower than water velocity so as to avoid causing the oil core to break up into segments.

9. A process for producing oil from an oil well and transporting the oil to a terminal station comprising:

utilizing water to recover oil from an oil formation through an oil well;

producing the oil as a water-in-oil emulsion from the oil well;

subjecting the emulsion to a high shear rate in conduit flow for a sufficiently long time to break the emulsion and create a water rich zone near the conduit wall resulting in core flow of an oil core in water annulus;

passing the core flow through a pump in the conduit to form another emulsion and subjecting the latter emulsion to sufficiently high shear rate in conduit flow for a sufficiently long time to break the emulsion and create a water rich zone near the conduit wall and reform the core flow;

transporting the oil and water to a terminal station;

separating the oil and water; and returning at least part of the water to be utilized for oil recovery and/or core flow.

10. The process of claim 9 wherein the water is injected into the oil formation to stimulate the oil well.

11. The process of claim 9 wherein the water is converted to steam which is injected into the oil formation to stimulate flow of the oil well.

12. The process of claim 9 wherein the water is combined with a water-soluble salt selected from the group consisting of silicates, borates, carbonates, sulfates, phosphates and mixtures thereof and injected into the oil well to coat surfaces therein with a coating of the salt and reduce the adherence of the crude oil to the surfaces, whereby production of oil from the oil well is improved.

13. The process of claim 12 wherein the oil contains a high percentage of waxy components.

14. The process of claim 9 wherein a water-soluble salt selected from the group consisting of silicates, borates, carbonates, sulfates, phpsphates and mixtures thereof is added to the water annulus.

15. The process of claim 9 wherein a water-soluble friction reducing polymer is added to the water annulus.

16. The process of claim 9 wherein a diffusor or inverted diffusor is employed to diffuse the core flow out of the core flow creating conduit to a conduit of a different size.

17. A process for producing oil from an oil well and transporting the oil to a terminal station comprising:

utilizing water to recover oil from an oil formation through an oil well;

producing the oil as a water-in-oil emulsion from the oil well;

adding water to the emulsion;

subjecting the added water and emulsion to a high shear rate in conduit flow for a sufficiently long time to break the emulsion and create a water rich zone near the conduit wall resulting in core flow of an oil core in water annulus;

passing the core flow through a pump in the conduit to form another emulsion and subjecting the latter emulsion to sufficiently high shear rate in conduit flow for a sufficiently long time to break the emulsion and create a water rich zone near the conduit wall and reform the core flow;

transporting the oil and water to a terminal station;

separating the oil and water; and returning at least part of the water to be utilized for oil recovery and/or for established core flow.

18. The process of claim 17 wherein the water is injected into the oil formation to drive the oil to the oil well.

19. The process of claim 17 wherein the water is converted to steam which is injected into the oil formation to stimulate the flow of oil to the oil well.

20. The process of claim 17 wherein the water is combined with a water-soluble salt selected from the group consisting of silicates, borates, carbonates, sulfates, phosphates and mixtures thereof and injected into the oil well to coat surfaces therein with a coating of the salt and reduce the adherence of the crude oil to the surfaces, whereby production of oil from the oil well is improved.

21. The method of claim 20 wherein the oil contains a high percentage of waxy components.

22. The process of claim 17 wherein the water is combined with a water-soluble salt selected from the group consisting of silicates, borates, carbonates, sulfates, phosphates and mixtures thereof and utilized to establish core flow, whereby transportation of the oil is improved.

23. The process of claim 17 wherein the water is combined with friction reducing polymers and utilized for establishing core flow.

24. The process of claim 17 wherein a diffusor or inverted diffusor is employed to diffuse the core flow out of the core flow creating conduit to a conduit of a different size.

25. A process for transporting crude oil from an oil well to a terminal station comprising:

producing crude oil from an oil well;

establishing core flow of the oil in an annulus of water inside a conduit;

transporting the resulting oil core in water annulus to a terminal station;

separating the oil and water; and returning at least part of the water to the oil well to be utilized for establishing core flow.

26. The process of claim 25 wherein the water is combined with a water-soluble salt selected from the group consisting of silicates, borates, carbonates, sulfates, phosphates and mixtures thereof and injected into the oil well to coat surfaces therein with a coating of the salt and reduce the adherence of the crude oil to the surfaces, whereby production of oil from the oil well is improved.

27. The method of clalim 25 wherein the oil contains a high percentage of waxy components.

28. The process of claim 25 wherein the water is combined with a water-soluble salt selected from the group consisting of silicates, borates, carbonates, sulfates, phosphates and mixtures thereof and utilized to establish core flow, whereby transportation of the oil is improved.

29. The process of claim 25 wherein the water is combined with friction reducing polymers and utilized for establishing core flow.

30. A process for transporting crude oil from an oil well to a terminal station comprising:

producing a water-in-oil emulsion from an oil well;

adding water to the emulsion;

subjecting the added water and emulsion to a high shear rate in conduit flow for a sufficiently long time to break the emulsion and create a water rich zone near the conduit wall resulting in core flow of an oil core in the water annulus;

passing the core flow through a pump in the conduit to form another emulsion and subjecting the latter emulsion to sufficiently high shear rate in conduit flow for a sufficiently long time to break the emulsion and create a water rich zone near the conduit wall and reform the core flow;

transporting the oil and water to a terminal station;

separating the oil and water; and returning at least part of the water to the oil well to be added to the produced emulsion.

31. The process of claim 30 wherein the water is combined with a water-soluble salt selected from the group consisting of silicates, borates, carbonates, sulfates, phosphates and mixtures thereof and injected into the oil well to coat surfaces therein with a coating of the salt and reduce the adherence of the crude oil to the surfaces, whereby production of oil from the oil well is improved.

32. The method of claim 30 wherein the oil contains a high percentage of waxy components.

33. The process of claim 30 wherein the oil is waxy crude oil and at least part of the returned water utilized for establishing core flow is added to the water-soluble salts selected from the group consisting of silicates, borates, carbonates, sulfates, phosphates and mixtures thereof and utilized to maintain an oleophobic film barrier between the waxy crude oil and the interior of a pipe.

34. The process of claim 30 wherein the water is combined with friction reducing polymers and utilized for establishing core flow.

35. The process of claim 30 wherein a diffusor or inverted diffusor is employed to diffuse the core flow out of the core flow creating conduit to a conduit of a different size.

* * * * *